US010602800B2

(12) United States Patent
Chang

(10) Patent No.: US 10,602,800 B2
(45) Date of Patent: Mar. 31, 2020

(54) ELECTRICALLY CONDUCTIVE SHOE

(71) Applicant: HAKA CO., LTD., Taichung (TW)

(72) Inventor: Wen Tsung Chang, Taichung (TW)

(73) Assignee: Haka Co., Ltd., Taichung (TW)

( * ) Notice: Subject to any disclaimer, the term of this patent is extended or adjusted under 35 U.S.C. 154(b) by 29 days.

(21) Appl. No.: 16/131,480

(22) Filed: Sep. 14, 2018

(65) Prior Publication Data

US 2019/0307204 A1 Oct. 10, 2019

(30) Foreign Application Priority Data

Apr. 9, 2018 (TW) ..... 107204499 U

(51) Int. Cl.
*A43B 7/36* (2006.01)
*A43B 17/00* (2006.01)

(52) U.S. Cl.
CPC ..... *A43B 7/36* (2013.01); *A43B 17/003* (2013.01)

(58) Field of Classification Search
CPC ..... A43B 7/36; A43B 3/163
USPC ..... 361/223
See application file for complete search history.

(56) References Cited

U.S. PATENT DOCUMENTS 6,219,942 B1 * 4/2001 Fini ..... A43B 1/0045 36/132
6,549,391 B1 * 4/2003 Bisson ..... A43B 3/0005 361/223
7,471,497 B1 * 12/2008 Knight, Sr. ..... A43B 7/36 361/212
2010/0205833 A1 * 8/2010 Wang ..... A43B 7/36 36/30 R

FOREIGN PATENT DOCUMENTS

WO WO01/87103 * 11/2001

* cited by examiner

*Primary Examiner* — Ted Kavanaugh
(74) *Attorney, Agent, or Firm* — Wang Law Firm, Inc.

(57) ABSTRACT

An electrically conductive shoe includes a shoe body having an upper, a midsole, and an outsole, and the outsole has a receiving chamber. The receiving chamber is communicated with a bore of the midsole. A conductive device is mounted on a bottom of the outsole. A flexible conductive member has an end electrically connected to the conductive device and an opposite end extending to an inner space of the upper through the receiving chamber of the outsole and the bore of the midsole and attached to an inner side of the upper.

21 Claims, 8 Drawing Sheets

ELECTRICALLY CONDUCTIVE SHOE

BACKGROUND OF THE INVENTION

1. Technical Field

The present invention relates to footwear, and more particularly to an electrically conductive shoe.

2. Description of Related Art

Typically, electrically conductive shoes may conduct static electricity of human body to the ground. Some of the conventional electrically conductive shoes provide a conductive device on an insole. The insole has a first conductive member on a top side, a second conductive device on a bottom side, and a third conductive member conducting the first conductive member to the second conductive member. When a user wears the electrically conductive shoes and steps on the insole, static electricity of human body may be conducted to the ground through the first conductive member, the third conductive member, the second conductive member, and an outsole. Such electrically conductive shoes may work only when the user wears conductive socks or wears no socks.

An improved conventional electrically conductive shoe provides a conductive ring fastened to an ankle to conduct static electricity. The problem of such electrically conductive shoes is that fewer users will wear the conductive rings on the ankles.

In addition, it usually has a complex process to manufacture the conventional electrically conductive shoes, so the price of them is high, and cannot cost down.

BRIEF SUMMARY OF THE INVENTION

In view of the above, the primary objective of the present invention is to provide an electrically conductive shoe, which may conduct static electricity of human body to the ground.

The secondary objective of the present invention is to provide an electrically conductive shoe, which has an easy way to manufacture the shoes.

In order to achieve the objective of the present invention, an electrically conductive shoe includes a shoe body having an upper, a midsole, and an outsole, wherein the midsole is connected to a bottom of the upper, and the outsole is attached to a bottom of the midsole; the midsole has a bore, and the outsole has a receiving chamber; the receiving chamber is communicated with the bore; a conductive device, which is made of a conductive material, mounted on a bottom of the outsole, wherein the conductive device is under the receiving chamber of the outsole; and a flexible conductive member, which is made of a conductive material, having an end electrically connected to the conductive device and an opposite end extending to an inner space of the upper through the receiving chamber of the outsole and the bore of the midsole and attached to an inner side of the upper.

The present invention further provides a method of making an electrically conductive shoe includes the following steps:

1. Mount a conductive device on a bottom of an outsole, wherein the conductive device has a plurality of through holes, and the outsole has a receiving chamber above the conductive device and communicated with the through hole.

2. Insert opposite ends of a conductive wire into the through holes of the conductive device and receiving sections of the conductive wire which pass through the through hole in the receiving chamber.

3. Bond an upper and a midsole to the outsole, wherein the midsole has a bore communicated with the receiving chamber of the outsole.

4. Pull the conductive wire in the receiving chamber of the outsole out via the bore of the midsole; and 5. Attach a conductive tape, which is coated with an adhesive on a side, to the midsole and the upper to cover the conductive wire thereunder.

Whereby the electrically conductive shoe may conduct static electricity of human body to the ground through the conductive tape, the conductive wire, and the conductive device in sequence.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
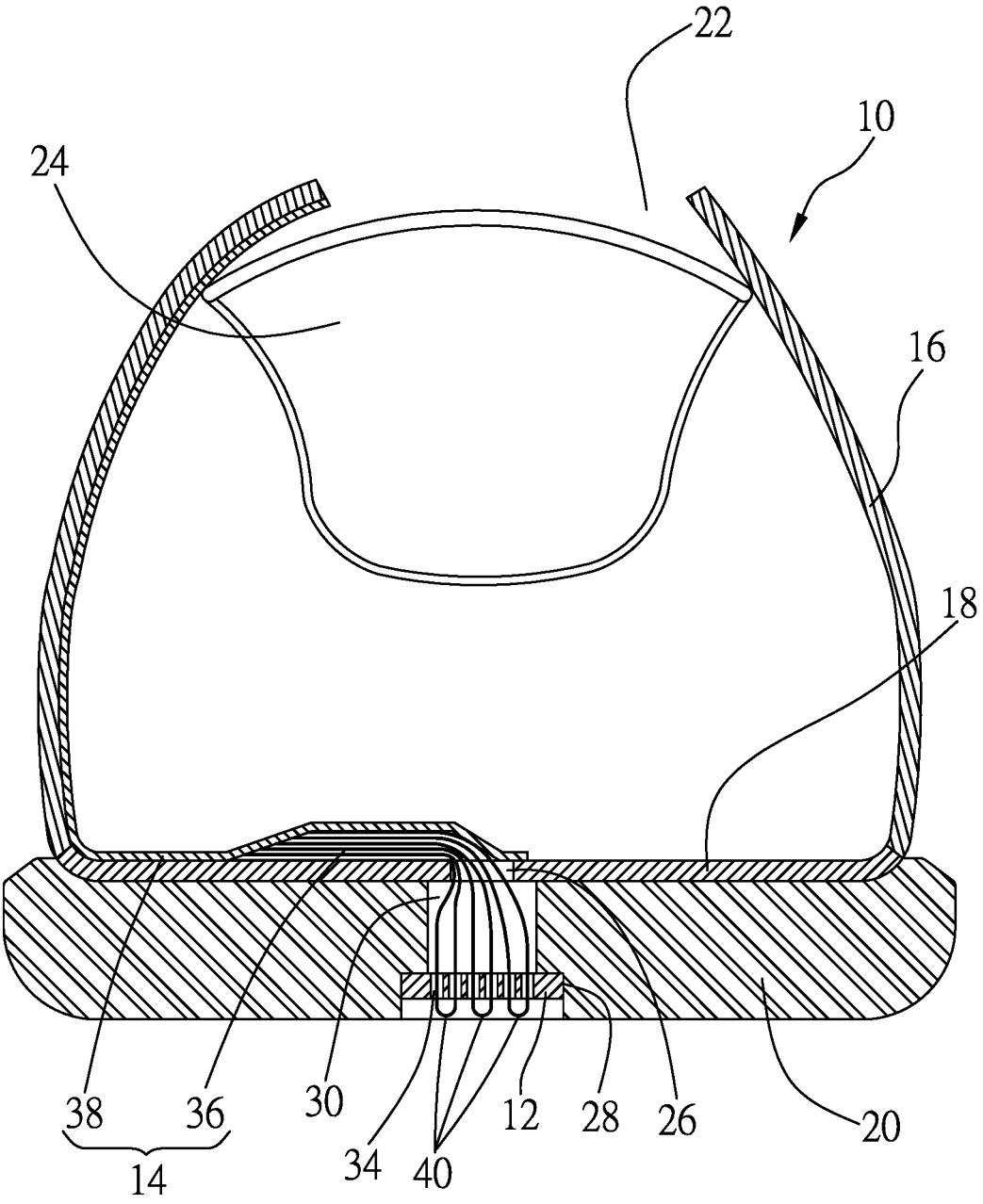
FIG. 1 is a sectional view of a first preferred embodiment of the present invention.

FIG. 1 shows an electrically conductive shoe of the first preferred embodiment of the present invention, includes a shoe body 10, a conductive device 12, and a conductive member 14. The shoe body 10 has an upper 16, a midsole 18, and an outsole 20. The upper 16 has an opening 22 at a top thereof and a tongue 24 besides the opening 22. The midsole 18 is fixed to a bottom of the upper 16. The outsole 20 is connected to a bottom of the midsole 18 and the upper 16. Above elements are the same as a conventional shoe, so we do not describe the detail here.

The midsole 18 is provided with a bore 26. The outsole 20 is provided with a slot 28 at a bottom side thereof, and a receiving chamber 30 at a top side thereof. The slot 28 is communicated with the receiving chamber 30, and the receiving chamber 30 is communicated with the bore 26 of the midsole 18. It is noted that positions of the bore 26, the receiving chamber 30 and the slot 28 are in association with an arch of a foot.

Figure 2:
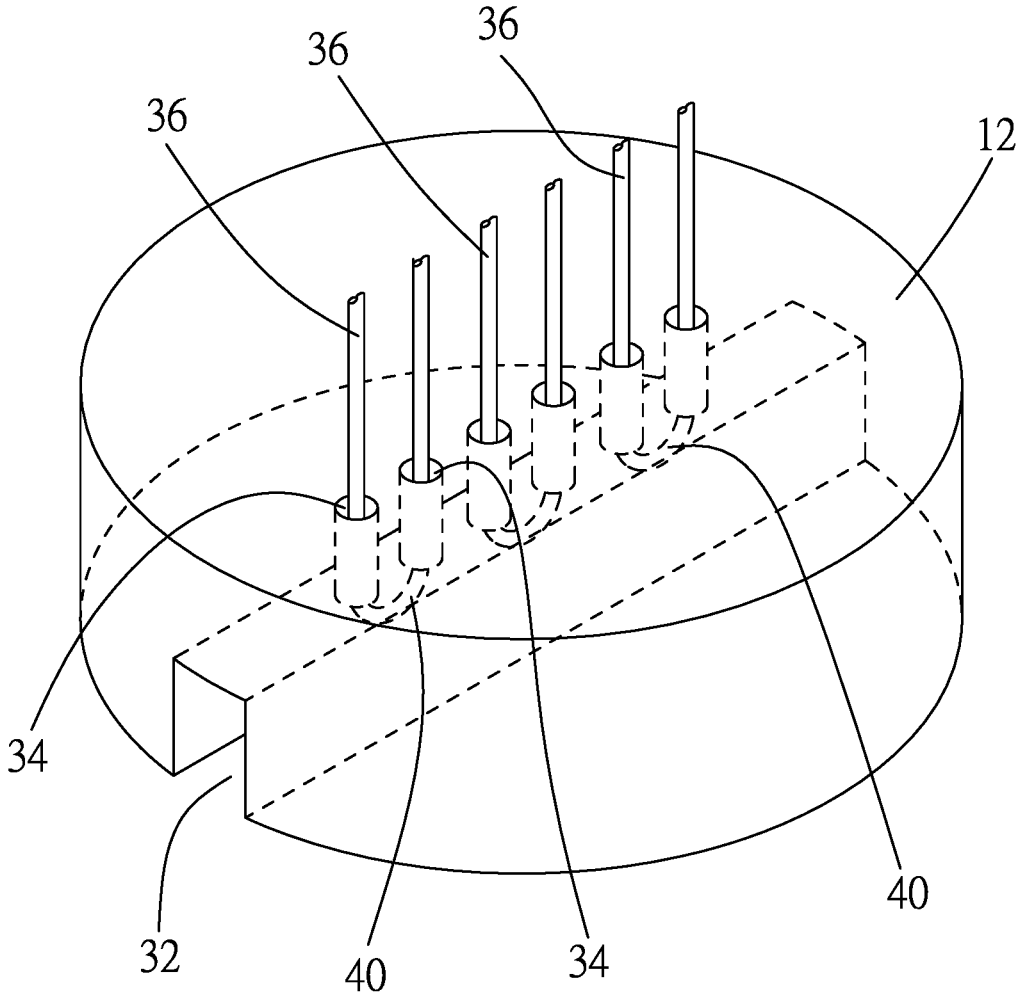
FIG. 2 is a perspective view of the conductive device of the first preferred embodiment of the present invention.

The conductive device 12 is made of a conductive rubber, having an electrical resistance between 0Ω and $1\times10^6$Ω. The conductive device 12 is mounted in the slot 28 of the outsole 20. As shown in FIG. 2, the conductive device 12 has a recess 32 on a bottom side thereof and a plurality of through holes 34 communicated with the recess 32. The through holes 34 are communicated with the receiving chamber 30 as well. In the first preferred embodiment, the recess 32 is elongated and straight, and the through holes 34 are aligned in a line on a bottom of the recess 32.

The flexible conductive member 14 includes a plurality of flexible conductive wires 36 and a flexible conductive tape 38. In the first preferred embodiment, the conductive wires 36 and the conductive tape 38 are made of flexible conductive materials, and the conductive tape 38 is coated with a conductive adhesive on a side thereof. Opposite ends of the conductive wires 36 pass through the through holes 34 of the conductive device 12 via the ends on the bottom of the recess 32, and then extend to an inner space of the upper 16 through the receiving chamber 30 of the outsole 20 and the bore 26 of the midsole 18 in sequence. The conductive wires 36 each has a loop section 40 received in the recess 32 of the conductive device 12. It is noted that the loop sections 40 of the conductive wires 36 are suspended in the recess 32, and distal ends thereof are received in the recess 32, so that the conductive wires 36 will not contact with the ground. Sections of the conductive wires 36 in the inner space of the upper 16 are bent and rested on the midsole 18 (some portions may be rested on the upper 16), and the conductive tape 38 is attached to the midsole 18 to cover the conductive wires 36 and the bore 26 of the midsole 18 thereunder. As a result, the ends of the conductive wires 36 are fixed to the midsole 18 by the conductive tape 38.

The conductive tape 38 has a part attached to the midsole 18 to fix the conductive wires 36 and seal the bore 26, and the rest part of the conductive tape 38 is attached to an interior side the upper 16. A highest end of the conductive tape 38 extends to an edge of the opening 22 of the upper 16. This may increase the possibility for the conductive tape 38 directly contacting with human body when a user wears anklet socks or wears no sock that may conduct static electricity of human body to the ground through the conductive tape 38, the conductive wires 36, and the conductive device 12.

Figure 3:
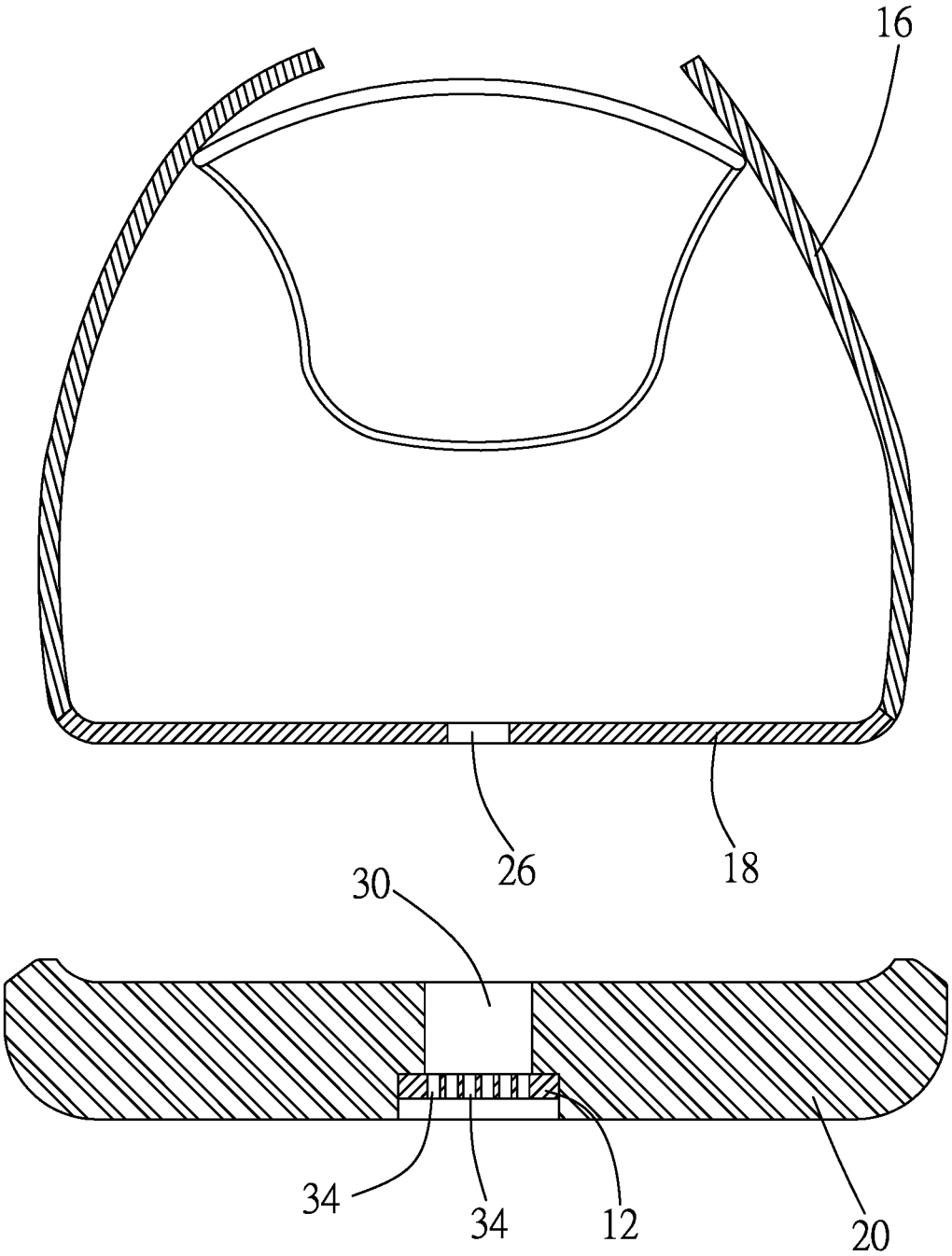
FIG. 3 to FIG. 6 are sketch diagrams of the first preferred embodiment of the present invention, showing the steps of making the electrically conductive shoe.

As shown in FIG. 3 to FIG. 7, a method of making the electrically conductive shoe of the first preferred embodiment of the present invention includes the following step:

1. Connect the upper 16 to the midsole 18, and mount the conductive device 12 on the bottom of the outsole 20. In this step, the midsole 18 is connected to the upper 16, and the conductive device 12 is mounted in the slot 28 of the outsole 20 (FIG. 3).

Figure 4:
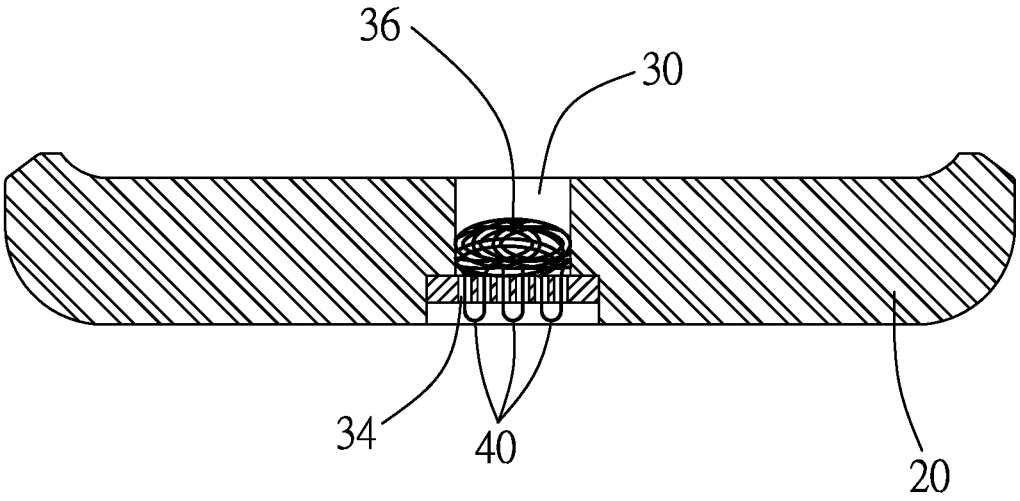
Figure 5:
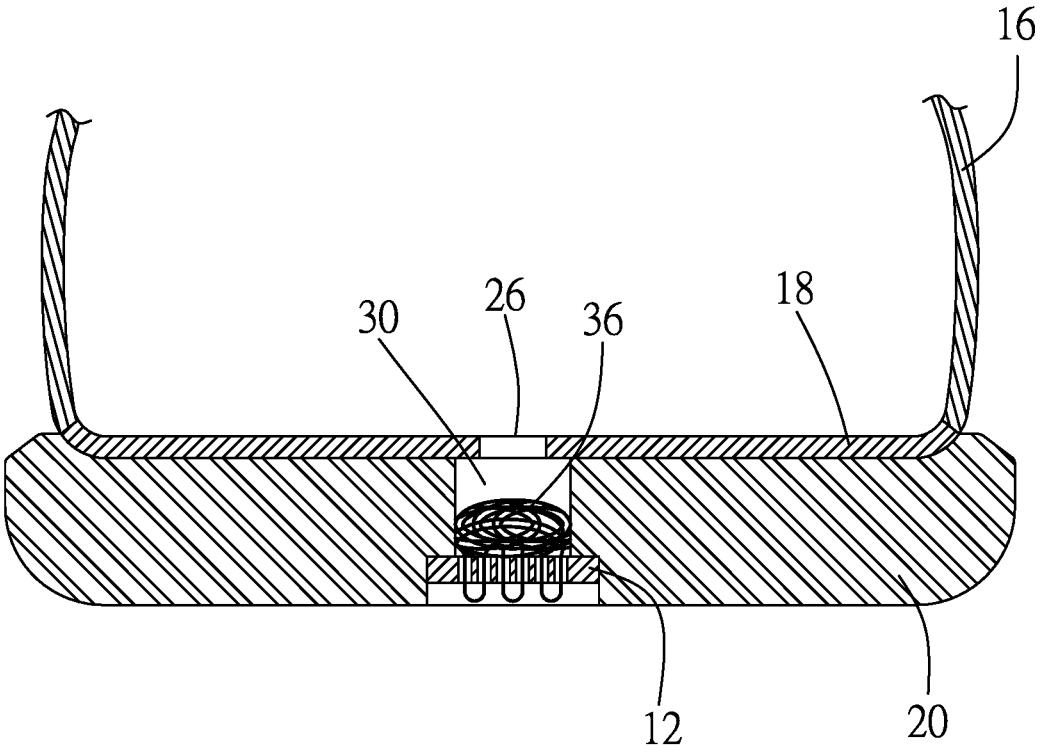

2. Insert the opposite ends of the conductive wires 36 into the through holes 34 of the conductive device 12 via the ends on the bottom of the recess 32, and receive sections of the conductive wires 36 which pass through the through holes 34 in the receiving chamber 30 of the outsole 20. As shown in FIG. 4, the opposite ends of the conductive wires 36 are inserted into the through holes 34 of the conductive device 12 via the end on the bottom of the recess 32. For the sections of the conductive wires 36 which pass through the through holes 34 are twisted and received in the receiving chamber 30.

3. Bond the outsole 20 to the upper 16 and the midsole 18. As shown FIG. 5, the outsole 20 is bonded to the upper 16 and the midsole 18 while the sections of the conductive wires 36 are still in the receiving chamber 30 and under the bore 26 of the midsole 18.

Figure 6:
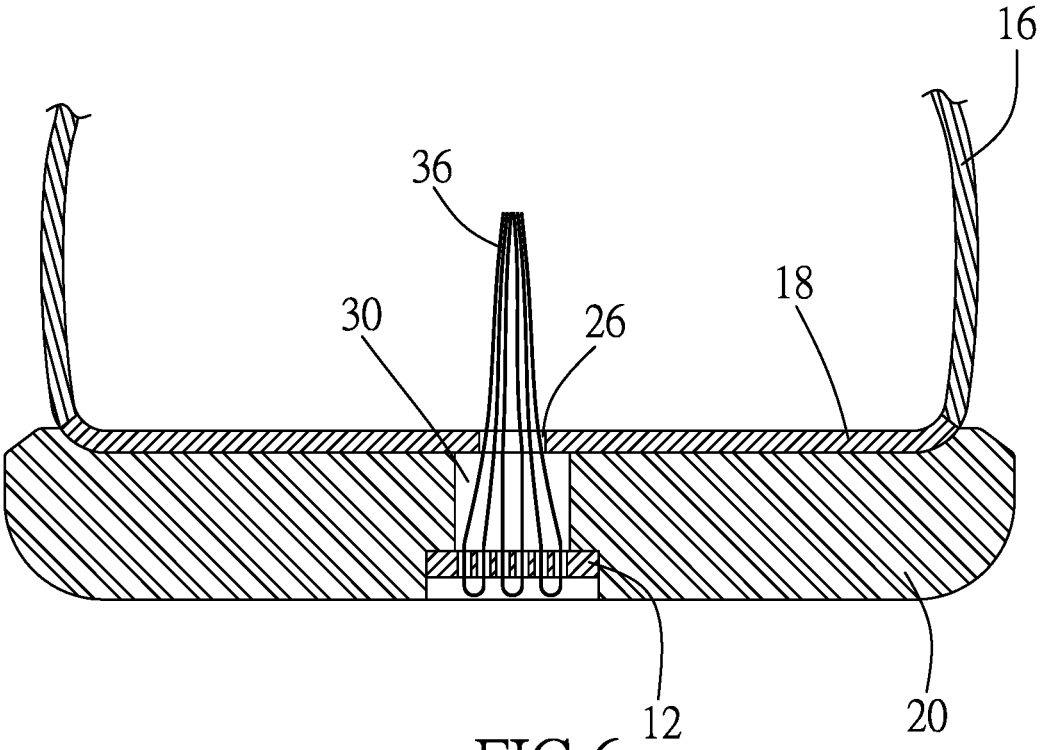

4. Pull the conductive wires 36 in the receiving chamber 30 of the outsole 20 out via the bore 26 of the midsole 18. After the outsole 20 is firmly bonded to the upper 16 and the midsole 18, as shown in FIG. 6, a works may insert a pair of tweezers, or a tool similar to that, into the receiving chamber 30 via the bore 26 of the midsole 18 and pull the conductive wires 36 in the receiving chamber 30 out, so that the conductive wires 36 have sections received in the inner space of the upper 16; and 5. Attach the conductive tape 38 on the midsole 18 and the upper 16 and cover the conductive wires 36 thereunder. Before attaching the conductive tape 38, the conductive wires 36 are cut to have suitable lengths. Next, the conductive wires 36 are bent and rested on the midsole 18, and then the conductive tape 38 is attached to the midsole 18 to cover the conductive wires 36 and the bore 26 thereunder, and is attached to the interior side of the upper 16. As described above, the highest end of the conductive tape 38 extends to the edge of the opening 22 of the upper 16. The electrically conductive shoe of the first preferred embodiment is done as shown in FIG. 1.

Figure 7:
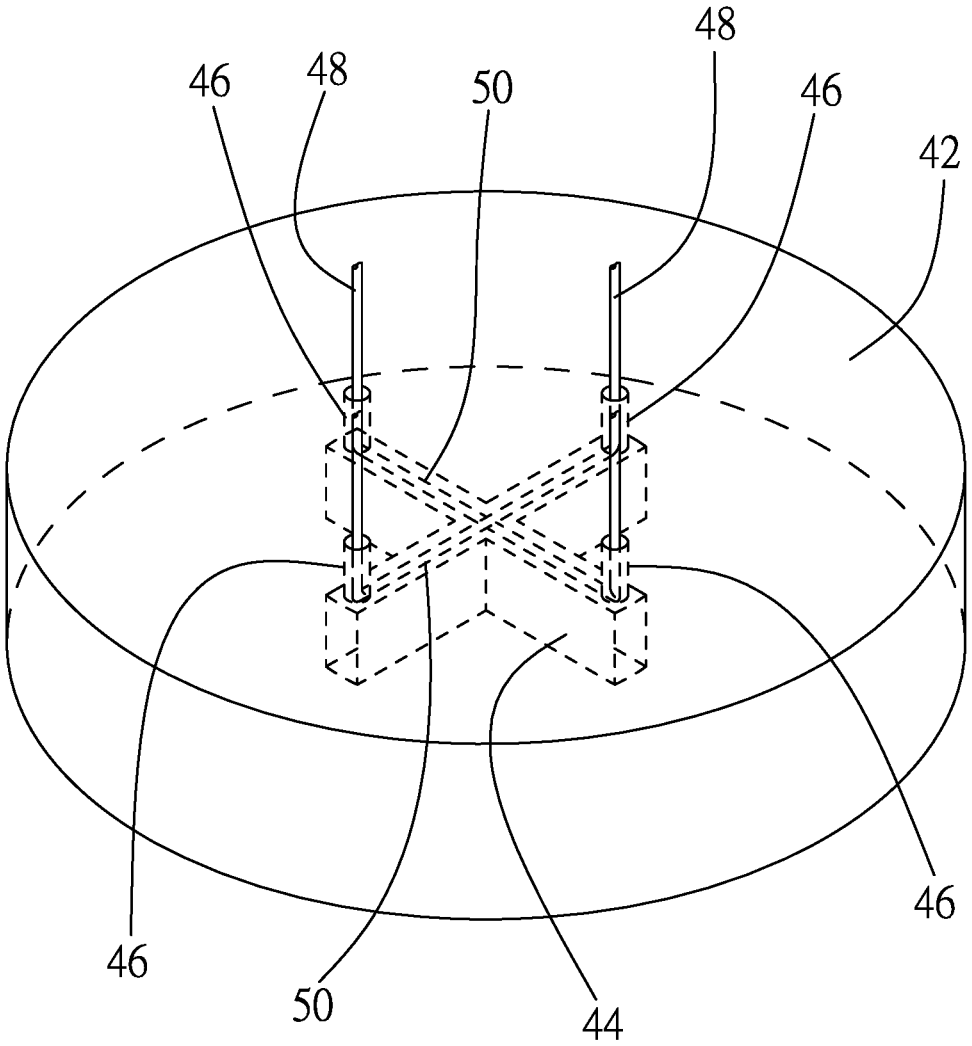
FIG. 7 is a perspective view of the conductive device of a second preferred embodiment of the present invention.

FIG. 7 shows a conductive device 42 of the second preferred embodiment of the present invention, which is provided with an X-shaped recess 44 on a bottom thereof and four through holes 46 at four distal ends of the X-shaped recess 44. Two conductive wires 48 have opposite ends inserted into the through holes 46 of the conductive device 42, so that they have loop sections 50 received in the recess 44 in an X-shaped pattern. In the second preferred embodiment, the loop sections 50 of the conductive wires 48 rest against a bottom of the recess 44.

Figure 8:
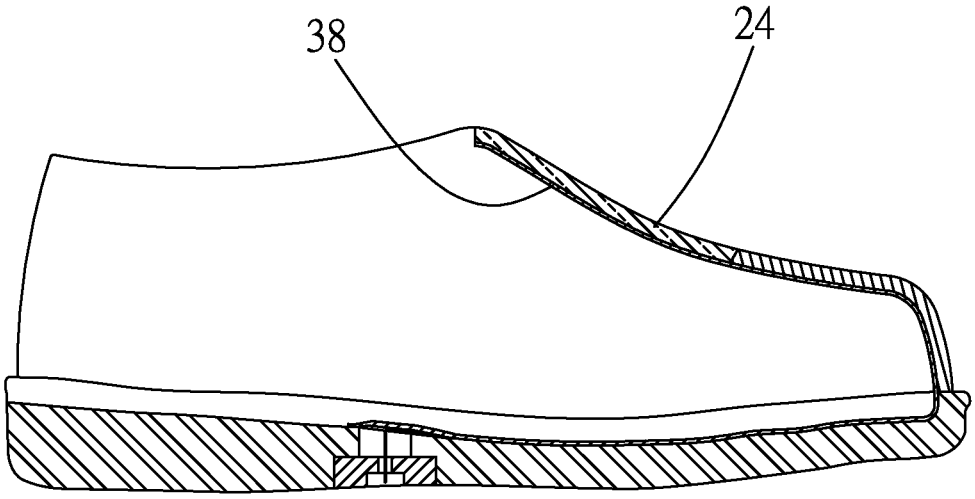
FIG. 8 is a sectional view of a third preferred embodiment of the present invention.

As described above, the highest end of the conductive tape 38 extends as higher as possible to directly contact with human body when the user wears no socks or wears anklet socks. FIG. 8 shows the conductive tape 38 extends to an interior side of the tongue 24 in order to directly contact with human body. It is noted that the flexible conductive member 14 may extend to all directions as long as it may directly contact with human body.

In conclusion, the electrically conductive shoe of the present invention may conduct static electricity of human body to the ground when the user wears no sock or wears anklet socks. Besides, the insole will not interfere the conductive way since the flexible device extends along the interior sides of the midsole and the upper. Furthermore, the present invention provides an easy way to manufacture the shoes with the receiving chamber to receive the conductive wires for the following procedures.

It must be pointed out that the embodiments described above are only some preferred embodiments of the present invention. All equivalent structures which employ the concepts disclosed in this specification and the appended claims should fall within the scope of the present invention.

What is claimed is:

1. A method of making an electrically conductive shoe, comprising the steps of:

mounting a conductive device on a bottom of an outsole, wherein the conductive device has a plurality of through holes, and the outsole has a receiving chamber above the conductive device and communicated with the through hole;

inserting opposite ends of a conductive wire into the through holes of the conductive device and receiving sections of the conductive wire which pass through the through hole in the receiving chamber;

bonding an upper and a midsole to the outsole, wherein the midsole has a bore communicated with the receiving chamber of the outsole;

pulling the conductive wire in the receiving chamber of the outsole out via the bore of the midsole;

attaching a conductive tape to the midsole and the upper to cover the conductive wire thereunder.

2. The method of claim 1, further comprising the step of cutting the conductive wire before attaching the conductive tape.

3. The method of claim 1, wherein the conductive device is provided with a recess on a bottom thereof, and the through holes are communicated with the recess; the conductive wire has a loop section received in the recess.

4. The method of claim 3, wherein the loop section of the conductive is suspended in the recess of the conductive device.

5. The method of claim 3, wherein the loop section of the conductive rests against a bottom of the recess of the conductive device.

6. The method of claim 3, wherein the recess is an X-shaped recess, and the through holes are located at distal ends of the X-shaped recess.

7. The method of claim 1, wherein the conductive tape covers the bore of the midsole.

8. The method of claim 1, wherein a highest end of the conductive tape is adjacent to an edge of an opening of the upper.

9. The method of claim 1, wherein a highest end of the conductive tape extends to an interior side of a tongue of the upper.

10. The method of claim 1, wherein an electrical resistance of the conductive device is between $0\Omega$ and $1\times10^6\Omega$.

11. An electrically conductive shoe, comprising:

a shoe body having an upper, a midsole, and an outsole, wherein the midsole is connected to a bottom of the upper, and the outsole is attached to a bottom of the midsole; the midsole has a bore, and the outsole has a receiving chamber; the receiving chamber is communicated with the bore;

a conductive device, which is made of a conductive material, mounted on a bottom of the outsole, wherein the conductive device is under the receiving chamber of the outsole; and a flexible conductive member, which is made of a conductive material, having an end electrically connected to the conductive device and an opposite end extending to an inner space of the upper through the receiving chamber of the outsole and the bore of the midsole and attached to an inner side of the upper.

12. The electrically conductive shoe of claim 11, wherein the flexible conductive member has a conductive wire and a conductive tape, and the conductive wire is electrically connected to the conductive device and extends to an inner space of the upper through the receiving chamber of the outsole and the bore of the midsole.

13. The electrically conductive shoe of claim 12, wherein the conductive device has a plurality of through holes which are communicated with the receiving chamber of the outsole; opposite ends of the conductive wire are inserted into the through hole and extend to the inner space through the receiving chamber of the outsole and the bore of the midsole.

14. The electrically conductive shoe of claim 13, wherein the conductive device is provided with a recess on a bottom thereof, and the through holes are communicated with the recess; the conductive wire has a loop section received in the recess.

15. The electrically conductive shoe of claim 14, wherein the loop section of the conductive is suspended in the recess of the conductive device.

16. The electrically conductive shoe of claim 14, wherein the loop section of the conductive rests against a bottom of the recess of the conductive device.

17. The electrically conductive shoe of claim 13, wherein the recess is an X-shaped recess, and the through holes are located at distal ends of the X-shaped recess.

18. The electrically conductive shoe of claim 12, wherein the conductive tape covers the bore of the midsole.

19. The electrically conductive shoe of claim 11, wherein a highest end of the flexible conductive device is adjacent to an edge of an opening of the upper.

20. The electrically conductive shoe of claim 11, wherein a highest end of the flexible conductive device extends to an interior side of a tongue of the upper.

21. The electrically conductive shoe of claim 11, wherein an electrical resistance of the conductive device is between $0\Omega$ and $1\times10^6\Omega$.

* * * * *